US008194016B2

(12) United States Patent
Yoshiga et al.

(10) Patent No.: US 8,194,016 B2
(45) Date of Patent: Jun. 5, 2012

(54) LIQUID CRYSTAL DISPLAY WITH PEEP-PREVENTING FUNCTION

(75) Inventors: Masahiro Yoshiga, Hyogo (JP); Minoru Shibazaki, Hyogo (JP)

(73) Assignee: Chimei Innolux Corporation, Miao-Li County (TW)

( * ) Notice: Subject to any disclaimer, the term of this patent is extended or adjusted under 35 U.S.C. 154(b) by 923 days.

(21) Appl. No.: 12/237,156

(22) Filed: Sep. 24, 2008

(65) Prior Publication Data

US 2009/0079674 A1 Mar. 26, 2009

Related U.S. Application Data

(60) Provisional application No. 60/975,178, filed on Sep. 26, 2007.

(30) Foreign Application Priority Data

Jan. 18, 2008 (JP) ..... 2008-008676

(51) Int. Cl.
*G09G 3/36* (2006.01)

(52) U.S. Cl. ..... 345/87; 345/690

(58) Field of Classification Search ..... 345/87
See application file for complete search history.

(56) References Cited

U.S. PATENT DOCUMENTS

| | | | | |
|---|---|---|---|---|
| 4,924,415 | A * | 5/1990 | Winser | 345/422 |
| 6,445,434 | B2 | 9/2002 | Takato et al. | |
| 2003/0146893 | A1 * | 8/2003 | Sawabe | 345/89 |
| 2005/0253797 | A1 | 11/2005 | Kamada et al. | |
| 2006/0109224 | A1 * | 5/2006 | Chang et al. | 345/89 |
| 2008/0272995 | A1 | 11/2008 | Sakaguchi et al. | |

FOREIGN PATENT DOCUMENTS

| | | | |
|---|---|---|---|
| JP | 7017988 | | 1/1995 |
| JP | 9230377 | | 9/1997 |
| JP | 2001-264768 | A | 9/2001 |
| JP | 2004-208163 | | 7/2004 |
| JP | 2005-316211 | A | 11/2005 |
| JP | 2006-330391 | A | 12/2006 |
| JP | 2008-275855 | A | 11/2008 |
| WO | 2006106662 | A1 | 10/2006 |

* cited by examiner

*Primary Examiner* — Nitin Patel
*Assistant Examiner* — Andrew Schnirel
(74) *Attorney, Agent, or Firm* — Kirton McConkie; Evan R. Witt

(57) ABSTRACT

In an active matrix LCD, different signal voltages are applied to adjacent pixels or sub-pixels. Averaged brightness of the adjacent pixels or sub-pixels displays a typical γ curve while viewing right from the front, and on the other hand, displays a constant γ curve within a specified color level (signal voltage) range while viewing at a skew angle from the front. Accordingly, a true image can be seen from the front while the image becomes visibly unidentified at a skew angle from the front.

17 Claims, 4 Drawing Sheets

LIQUID CRYSTAL DISPLAY WITH PEEP-PREVENTING FUNCTION

CROSS REFERENCE TO RELATED PATENT APPLICATION

This patent application is based on a U.S. provisional patent application No. 60/975,178 filed on Sep. 26, 2007.

FIELD OF THE INVENTION

The present invention relates to an active matrix LCD, and more particularly to an active matrix LCD with a peep-preventing function.

BACKGROUND OF THE INVENTION

An active matrix LCD typically includes two transparent substrates formed with respective pixel electrodes facing each other and interposed with a layer of liquid crystal. The pixel electrodes are arranged as an array on each substrate, and a corresponding ON/OFF switch is disposed next to each pixel electrode for controlling the displaying of the corresponding pixel.

Conventionally, an as-wide-as-possible view angle is a goal of LCD designs in order not to limit the position of a user relative to the display plane. However, when an LCD is applicable to a portable device that can be used anywhere, data security becomes an issue and the requirement of wide view angle needs to be reconsidered. A wide view angle of an LCD likely means to open the displayed data to the public. Therefore, in a privacy-sensitive case, it is preferred that people around the user cannot identify what is being displayed.

For implementing the private mode, the image signal range has to be narrowed, which means the color level range (signal voltage range) should be narrowed, too. This would deteriorate the contrast of the displayed image, and thus the user himself cannot see a quality image from the front, either.

For solving this problem, Japanese Patent Publication No. Hei-09-230377 suggests a method for changing the viewing property by using a single LCD panel. The method is used in a VAN (vertical alignment nematic liquid crystal) mode. Under the VAN mode, the view angle with a slanting domain is extremely confined for the peep-preventing purpose. Therefore, it is inconvenient to use the LCD under the private mode.

Furthermore, Japanese Patent Publication No. 2007-17988 suggests the use of two LCD panels, which allows the displaying of pixels to be switched between a wide view angle mode and a narrow view angle mode. However, the use of two panels largely thickens the device and increases costs.

SUMMARY OF THE INVENTION

The present invention relates to an active matrix LCD. The active matrix LCD includes a pixel array comprising a plurality of pixel elements and a voltage source for supplying signal voltages to the pixel array for controlling brightness of the pixel array and displaying an image. Different levels of the signal voltages are applied to adjacent pixel elements, respectively, so that an averaged brightness of the adjacent elements varies with the signal voltages following a γ-curve to show an expected image when viewed at a normal position in front of the active matrix LCD, and the averaged brightness is at a constant level within a specified signal-voltage range to change a contrast of the image to a visibly unidentifiable degree when viewed at a skew position from the front of the active matrix LCD.

In an embodiment, the adjacent pixel elements are adjacent pixels or adjacent sub-pixels obtained by dividing a pixel.

In an embodiment, the active matrix LCD further comprises: a storage device for storing therein pixel data to be inputted to the pixel array; and a lookup table coupled to the storage device for recording therein voltage values corresponding to the pixel data and outputting the different voltages to the adjacent pixels or sub-pixels to differentiate the brightness viewed at the normal position and the skew position in a private-mode enabling state.

In an embodiment, the active matrix LCD further comprises a switch coupled to the lookup table and manipulated for selectively entering the active matrix LCD into the private-mode enabling state or a private-mode disabling state. Then, another lookup table coupled to the storage device is used instead of the private-mode lookup table to output voltages to the pixel array when the private-mode disabling state is selectively entered.

In an embodiment, the voltage values recorded in the lookup table is in a digital form and the active matrix LCD further comprises a digital-to-analog converter coupled to the lookup table for converting the voltage values into an analog form before applying the voltages to the adjacent pixels or sub-pixels.

In an embodiment, the specified signal-voltage range occupies 20%~80% of an entire signal-voltage range involving in the γ-curve to be outputted to the pixel array.

In an embodiment, the averaged brightness in a first zone of the pixel array is at the constant level within the specified signal-voltage range and the averaged brightness in a second zone of the pixel array is at another constant level within the specified signal-voltage range so as to show an image with deteriorating contrast when viewed at the skew position from the front of the active matrix LCD.

For example, the first zone and the second zone are horizontally adjacent to each other or vertically adjacent to each other. Alternatively, the pixel array may include a plurality of the first zones and a plurality of the second zones, and the first and second zones are alternately arranged to form a chessboard-like pattern.

The present invention also provides an electronic apparatus, comprising an active matrix LCD described above for displaying data.

For example, the electronic apparatus is a personal computer, a laptop computer, a personal digital assistant (PDA), a digital camera, a cell phone or a navigation system.

The present invention further provides a method for operating an active matrix LCD in a private mode, which includes: entering the active matrix LCD into a private-mode enabling state; dividing a pixel of a pixel array of the active matrix LCD into sub-pixels; and applying different signal voltages to the sub-pixels to obtain an averaged brightness of the sub-pixels; wherein the averaged brightness varies with the signal voltages following a γ-curve to show an expected image when viewed at a normal position in front of the active matrix LCD, and the averaged brightness is at a constant level within a specified signal-voltage range to show a blurred image when viewed at a skew position from the front of the active matrix LCD.

BRIEF DESCRIPTION OF THE DRAWINGS

The above contents of the present invention will become more readily apparent to those ordinarily skilled in the art after reviewing the following detailed description and accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
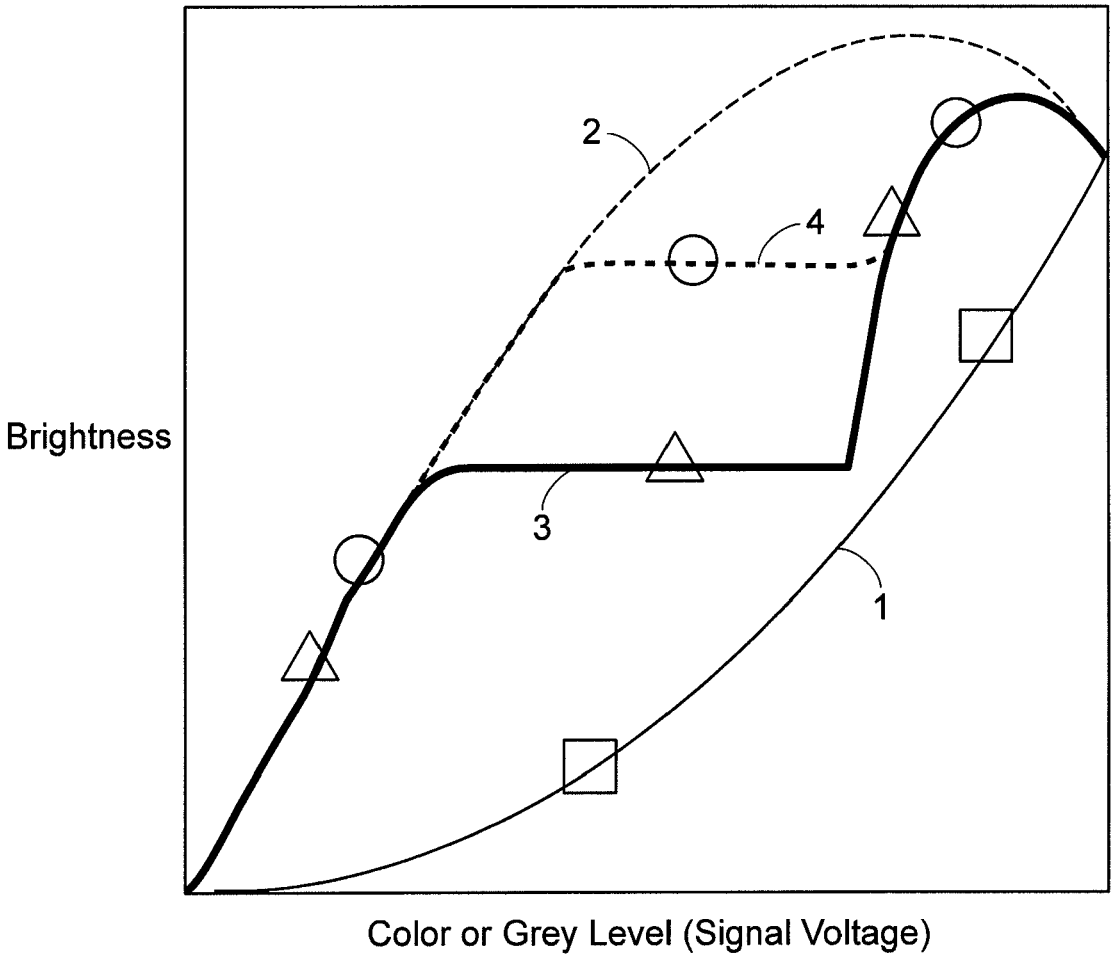
FIG. 1 is a plot illustrating the correlation of brightness to color level (signal voltage)
Figure 2:
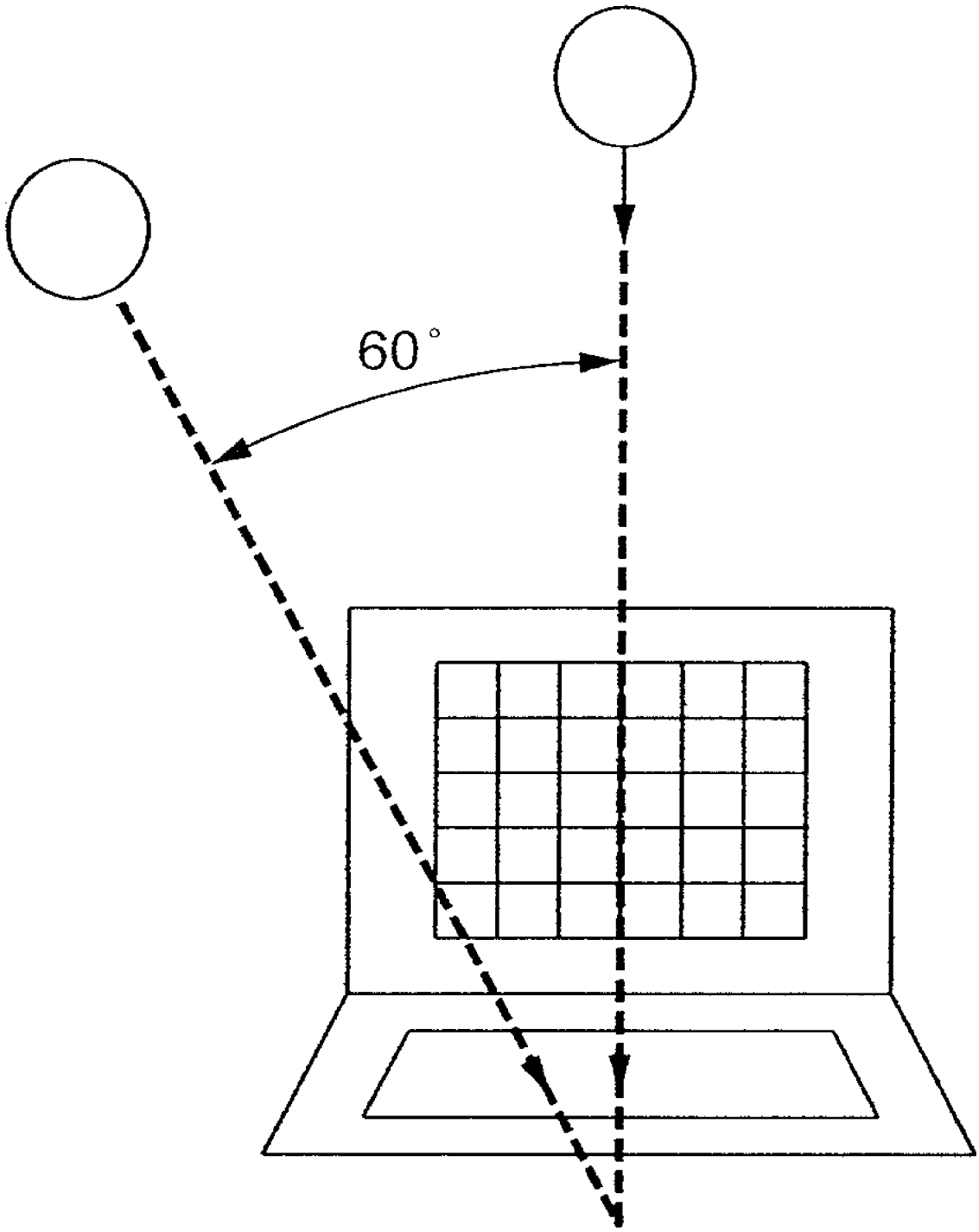
FIG. 2 is a schematic diagram illustrating a view angle 60-degree skew from the front.

A plot of brightness vs. color-level or grey-level (signal voltage) is depicted in FIG. 1. The presented curves are so-called as γ-curves, wherein Curve 1 is a typical γ-curve. In general, brightness increases with signal voltage in an exponential order. On the other hand, Curve 2 shows the brightness vs. color-level or grey-level variation in the viewing case of FIG. 2, i.e. viewing at a 60-degree angle skew from the front. It can also be seen from FIG. 1 that a pixel or sub-pixel shows two kinds of brightness in two viewing cases, one right from the front (Curve 1) and the other at an angle skew from the front (Curve 2).

For example, Curve 1 and Curve 2 respectively represent a function $I_0$ (V) and a function $I_{60}$ (V), wherein V is a voltage applied to a pixel and corresponding to a specified color or grey level, and the functions $I_0$ (V) and $I_{60}$ (V) represent the resulting brightness viewed at a normal position and a 60-degree skew position, respectively. In other words, Curve 1 shows the variation of brightness with the applied voltage when viewed right from the front while Curve 2 shows the variation of brightness with the applied voltage when viewed at a 60-degree angle skew from the front. Accordingly, for the same image, brightness is changed as a whole with the viewing positions. The image viewed at an angle skew from the front, although becoming dark, may still be identifiable.

Therefore, the present invention intends to further make the image visibly unidentifiable in the private mode. For achieving this object, different voltages are applied to adjacent pixels so as to differentiate brightness of adjacent pixels. Alternatively, a pixel can be divided into two or more sub-pixels and different voltages are applied to the sub-pixels to exhibit the similar effect. For example, voltages $V_1$ and $V_2$ are applied to adjacent Pixel 1 and Pixel 2, respectively. Accordingly, the brightness of the pixel set can be defined by an average of the two pixels. For example, the brightness of the pixel set can be $(I_0(V_1)+I_0(V_2))/2$ viewed from the front or it can be $(I_{60}(V_1)+I_{60}(V_2))/2$ viewed at a 60-degree angle skew from the front. According to an embodiment of the present invention, the voltage $V_1$ and $V_2$ are preset at proper levels so that the function $(I_0(V_1)+I_0(V_2))/2$ represents a typical γ-curve and the function $(I_{60}(V_1)+I_{60}(V_2))/2$ substantially represents a curve with constant brightness within a specified signal domain, like Curve 3 or 4. Since brightness represented by Curve 1 is supposed to vary with signal voltages to show an image, the constant brightness effect represented by Curve 3 or Curve 4 results in deteriorated contrast of the displayed image. In other words, a normal image with variable brightness can be seen from the front, while an image with constant brightness is seen at a skew angle. In this way, the image becomes visibly unidentifiable in the private mode.

Figure 3A:
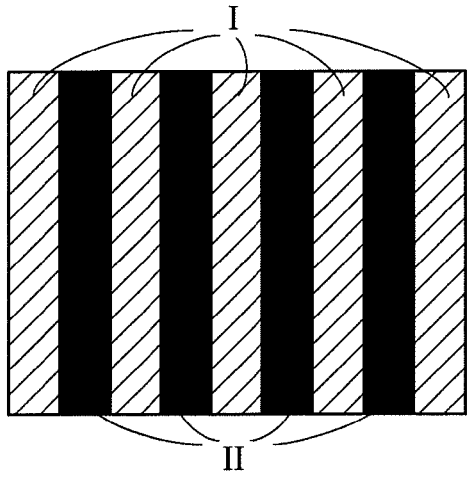
FIG. 3A is a schematic diagram illustrating a displayed image divided into vertical stripes with alternative high/low brightness in a private mode according to an embodiment of the present invention.
Figure 3B:
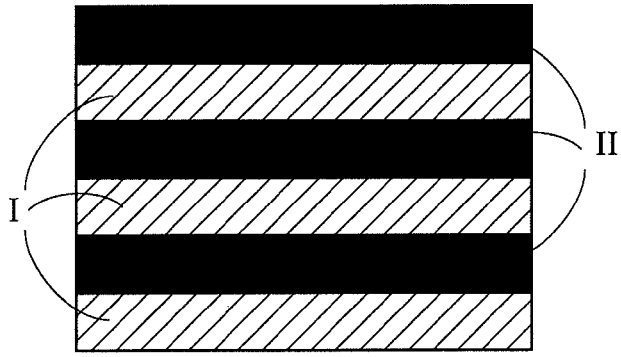
FIG. 3B is a schematic diagram illustrating a displayed image divided into horizontal stripes with alternative high/low brightness in a private mode according to another embodiment of the present invention.
Figure 3C:
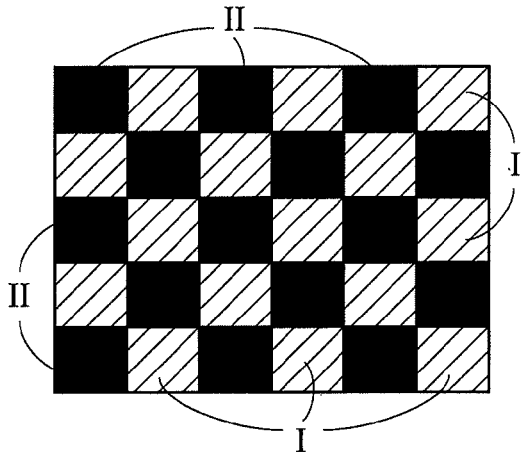
FIG. 3C is a schematic diagram illustrating a displayed image divided into blocks with alternative high/low brightness in a private mode according to a further embodiment of the present invention.

Assuming the function $(I_{60}(V_1)+I_{60}(V_2))/2$ of pixels in alternate rows follows Curve 3 and Curve 4, respectively, the resulting brightness will substantially form a pattern schematically shown in FIG. 3A. That is, when viewed at a skew angle, relatively high brightness zones I and relatively low brightness zones II alternately appear so as to conduct shaded effects and thus make the displayed image visibly unidentifiable. Other brightness patterns such as alternate horizontal stripes as shown in FIG. 3B and alternate chess blocks as shown in FIG. 3C also destroy normal image contrast and they can be achieved by properly adjusting voltages applied to the pixels and sub-pixels.

Figure 4:
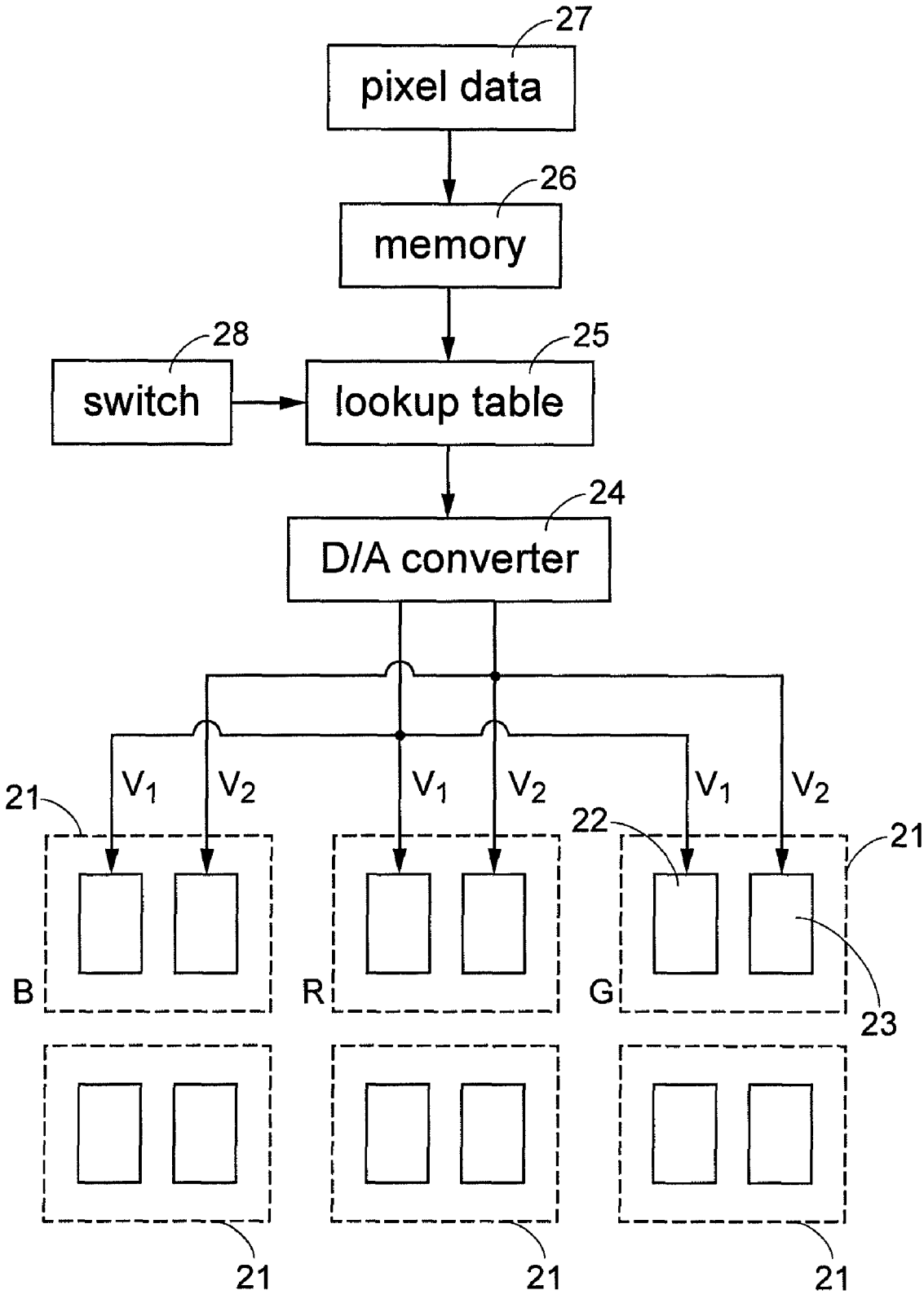
FIG. 4 is a scheme schematically showing the displaying means of an active matrix LCD according to the present invention.

FIG. 4 schematically shows how an active matrix LCD operates in the private mode as mentioned above. In the active matrix LCD, a plurality of pixels 21 each corresponding to one of three primary colors, i.e. red (R), green (G) and blue (B), are arranged in rows and columns. Each pixel 21 is further divided into two sub-pixels 22 and 23. Pixel data 27 are previously stored in a memory 26, and then outputted from the memory 26 to be converted into voltage data by a digital-to-analog (D/A) converter 24 according to a lookup table 25. On the other hand, output voltage values $V_1$ and $V_2$ are specifically set in order to render the normal γ-curve 1 of FIG. 1 at a normal position and render the special curve 3 of FIG. 1 at a skew position. The voltage values $V_1$ and $V_2$ are previously recorded in the lookup table 25 in a digital form and then converted into an analog form by a D/A converter 24 and applied to the sub-pixels 22 and 23, respectively.

The above embodiment illustrated with reference to FIG. 4 is based on the implementation that a pixel is divided into sub-pixels and different voltages are applied to the divided sub-pixels. Nevertheless, applying different voltages to adjacent pixels can be another embodiment to obtain a similar effect. The difference between these two embodiments is in resolution. The resulting resolution in the case of applying two voltages to two pixels is substantially half of that in the other case. Therefore, under the consideration of resolution, it is preferred to divide a pixel into sub-pixels and apply different voltages to the divided sub-pixels.

Preferably but not necessarily, a switch 28 is additionally provided and selectively manipulated to switch the LCD between a private-mode enabling state and a private-mode disabling state. The private-mode enabling state prevents from undesired peep in a public space, while the private-mode disabling state permits a wider view angle in a safe place. Corresponding to the private-mode enabling state and private-mode disabling state, the lookup table 25 includes a normal lookup table and a private-mode lookup table, one of which is selected to work according to a switching state of the switch 28. In other words, when the switch 28 is switched to enable the private mode, the private-mode lookup table is used to output different voltages $V_1$ and $V_2$ to adjacent pixels or sub-pixels so as to make the image visibly unidentifiable as described above. Accordingly, a clear image can be seen at a front position but a visibly unidentifiable image is seen at a skew position. On the other hand, when the switch 28 is switched to disable the private mode, the normal lookup table is used to output proper voltages for the pixels in a typical manner. As a result, the images seen at a normal position and a skew position have little difference so as to enlarge the view angle.

Furthermore, in order to make the image even hard to be identified when viewed at an angle skew from the front, a narrow signal-voltage range can be used. In order to obtain a γ-curve with a constant brightness region like Curve 3 or 4 of FIG. 1, the entire signal voltage should be limited to a specified range. If a voltage lying in the range corresponding to the constant brightness region like Curve 3 or 4 is used, the associated pixel region will show single brightness with viewing at an angle skew from the front. On the other hand, if two kinds of brightness levels corresponding to Curve 3 and 4 are present in adjacent pixel regions, respectively, a shaded effect is additionally imparted. Moreover, it is preferred that the specified voltage range resulting in constant brightness occupies 20%~80% of the entire voltage range involving in the γ-curve or γ-curves.

An active matrix LCD according to the present invention is adapted to be used in a variety of electronic apparatus such as personal computer, laptop computer, personal digital assistant (PDA), digital camera, cell phone, navigation system for displaying information. The private mode offered by the present invention is particularly valuable for a privacy-sensitive potable device, e.g. laptop computer, PDA or cell phone.

While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An active matrix LCD, comprising:

a pixel array comprising a plurality of pixel elements; and a voltage source supplying signal voltages to the pixel array for controlling brightness of the pixel elements in the pixel array and displaying an image;

wherein different levels of the signal voltages are applied to adjacent pixel elements, respectively;

wherein an averaged brightness of the adjacent elements is controlled to vary with the signal voltages following a first γ-curve to show an expected image when viewed at a normal position in front of the active matrix LCD; and the averaged brightness of the pixel elements in a first zone is controlled to vary with the signal voltages following a second γ-curve having a first constant level within a first specified signal-voltage range, and meanwhile, the averaged brightness of the pixel elements in a second zone of the pixel array is controlled to vary with the signal voltages following a third γ-curve having a second constant level within a second specified signal-voltage range, thereby changing a contrast of the image to a visibly unidentifiable degree when viewed at a skew position from the front of the active matrix LCD.

2. The active matrix LCD according to claim 1 wherein the adjacent pixel elements are adjacent pixels or adjacent subpixels obtained by dividing a pixel.

3. The active matrix LCD according to claim 1 further comprising:

a storage device for storing therein pixel data to be inputted to the pixel array; and a lookup table coupled to the storage device for recording therein voltage values corresponding to the pixel data and outputting the different voltages to the adjacent pixel elements to differentiate the brightness viewed at the normal position and the skew position in a private-mode enabling state.

4. The active matrix LCD according to claim 3 further comprising a switch coupled to the lookup table and manipulated for selectively entering the active matrix LCD into the private-mode enabling state or a private-mode disabling state.

5. The active matrix LCD according to claim 4 wherein another lookup table coupled to the storage device is used instead to output voltages to the pixel array when the private-mode disabling state is selectively entered.

6. The active matrix LCD according to claim 3 wherein the voltage values recorded in the lookup table is in a digital form and the active matrix LCD further comprises a digital-to-analog converter coupled to the lookup table for converting the voltage values into an analog form before applying the voltages to the adjacent pixel elements.

7. The active matrix LCD according to claim 1 wherein each of the specified signal-voltage range occupies 20%-80% of an entire signal voltage range involving in the corresponding γ-curve to be outputted to the pixel array.

8. The active matrix LCD according to claim 1 wherein the first zone and the second zone are adjacent rows or columns of the pixel array horizontally or vertically adjacent to each other.

9. The active matrix LCD according to claim 1 wherein the pixel array includes a plurality of the first zones and a plurality of the second zones, and the first and second zones are alternately arranged to form a chessboard-like pattern.

10. An electronic apparatus, comprising an active matrix LCD recited in claim 1 for displaying data.

11. The electronic apparatus according to claim 10 being selected from a personal computer, a laptop computer, a personal digital assistant (PDA), a digital camera, a cell phone or a navigation system.

12. A method for operating an active matrix LCD in a private mode, comprising:

entering the active matrix LCD into a private-mode enabling state; and applying different signal voltages to adjacent pixel elements of a pixel array, respectively, to result in a controlled averaged brightness;

wherein the averaged brightness is controlled to vary with the signal voltages following a first γ-curve to show an expected image when viewed at a normal position in front of the active matrix LCD; and the averaged brightness of the pixel elements in a first zone is controlled to vary with the signal voltages following a second γ-curve having a first constant level within a first specified signal-voltage range, and meanwhile, the averaged brightness of the pixel elements in a second zone of the pixel array is controlled to vary with the signal voltages following a third γ-curve having a second constant level within a second specified signal-voltage range, thereby changing a contrast of an image to a visibly unidentifiable degree when viewed at a skew position from the front of the active matrix LCD.

13. The method according to claim 12 wherein the adjacent pixel elements are adjacent pixels or adjacent sub-pixels obtained by dividing a pixel.

14. The method according to claim 12 further comprising a step of selectively entering the active matrix LCD into an enabling state or a disabling state of the private-mode.

15. The method according to claim 12 wherein each of the specified signal-voltage range occupies 20%-80% of an entire signal voltage range involving in the corresponding γ-curve to be outputted to the pixel array.

16. The active matrix LCD according to claim 14 wherein the first zone and the second zone are adjacent rows or columns of the pixel array horizontally or vertically adjacent to each other.

17. The active matrix LCD according to claim 14 wherein the pixel array includes a plurality of the first zones and a plurality of the second zones, and the first and second zones are alternately arranged to form a chessboard-like pattern.

* * * * *